US005426957A

United States Patent [19]

Yamaoka

[11] Patent Number: 5,426,957

[45] Date of Patent: Jun. 27, 1995

[54] METHOD OF KNITTING A FABRIC HAVING IMPROVED NON-RUN AND ELASTICITY CHARACTERISTICS

[75] Inventor: Takashi Yamaoka, Hyogo, Japan

[73] Assignee: Precision Fukuhara Works, Ltd., Japan

[21] Appl. No.: 269,479

[22] Filed: Jul. 1, 1994

[30] Foreign Application Priority Data

Jul. 5, 1993 [JP] Japan ..... 5-199274

[51] Int. Cl.[6] ..... D04B 9/26

[52] U.S. Cl. ..... 66/38; 66/41; 66/169 A

[58] Field of Search ..... 66/38, 41, 57, 107, 66/169 A, 169 R

[56] References Cited

U.S. PATENT DOCUMENTS

| | | | |
|---|---|---|---|
| 356,079 | 1/1887 | Place | 66/38 |
| 2,315,166 | 3/1943 | St. Pierre | 66/41 |
| 2,379,649 | 7/1945 | Nebel | 66/169 |
| 3,080,740 | 3/1963 | Nebel | 66/169 A X |
| 3,157,037 | 11/1964 | Nebvel et al. | 66/169 A X |
| 3,293,885 | 12/1966 | Nebel | 66/169 A X |
| 3,319,440 | 5/1967 | Nebel et al. | 66/169 A |

FOREIGN PATENT DOCUMENTS

| | | | |
|---|---|---|---|
| 911321 | 5/1954 | Germany | 66/169 A |
| 1064673 | 9/1959 | Germany | 66/169 A |

*Primary Examiner*—John J. Calvert

*Attorney, Agent, or Firm*—Bell, Seltzer, Park & Gibson

[57] ABSTRACT

A method of knitting single knit fabrics on a circular knitting machine such that the fabric has improved elasticity, soft hand and drapeability and including controlling two types of needles arranged alternately in the cylinder and sinkers arranged in the sinker dial through four processes in which alternate needles are raised to the knitting level in the first process and intervening needles are raised to the tucking level and an old loop has cleared the latch on each needle and a previously fed yarn is held in the hook of each intervening needle, a first ground yarn is fed to the alternate and intervening needles and the needles are lowered to a high welt level for the alternate needles so that the old loop is not knocked over and a low welt level for the intervening needles so that the old loop is knocked over and a new double yarn stitch loop is formed. The levels to which the alternate and intervening needles are raised are reversed in the third process.

4 Claims, 5 Drawing Sheets

METHOD OF KNITTING A FABRIC HAVING IMPROVED NON-RUN AND ELASTICITY CHARACTERISTICS

FIELD OF THE INVENTION

The present invention relates to the formation of single-knit fabrics having improved non-run, elasticity, soft hand and drapeability characteristics and more particularly to an improved method of producing such fabrics.

BACKGROUND OF THE INVENTION

It is well known to produce a knit fabric having elasticity of double plain jersey loops of a ground yarn and an elastic yarn. One example of such a knitting method includes raising all needles to the knitting level where the old loops clear the latches on the needles and feeding both the ground yarn and the elastic yarn to the needles. As the needles descend, the sinkers withdraw so that the old loops knock over at the sinker tops and double loops are formed by the needles and sinkers of the ground yarn and the elastic yarn in each loop.

While producing knit fabrics of excellent elasticity, this prior method has difficulties and deficiencies. For example, the elastic yarn causes the fabric to contract in both the course and wale directions which results in deformed loops. The resulting fabric has a hard hand and poor drapeability. Also, elastic yarn breakage is difficult to correct during knitting of such fabric.

Another example of a prior method of producing knit fabric having double jersey loops is disclosed in U.S. Pat. No. 2,379,649. While producing a single-knit fabric of double jersey loops which overcomes the difficulties and deficiencies of the aforementioned method, the method of this prior patent has other difficulties and deficiencies. For example, the needles of the knitting machine are arranged in two groups and the two yarns are alternately fed to the front and the back of the hooks of the knitting needles in the two groups. To accomplish this, the group of needles to the back of which a yarn is being fed must rise sharply at the back of the first yarn guide. This type of yarn feeding is difficult and inaccurate and frequently results in less than desirable quality.

SUMMARY OF THE INVENTION

With the foregoing in mind, it is an object of the present invention to provide a method of producing easily and accurately fabrics having a soft hand and much elasticity and in which no elastic yarn is used and no special yarn feeding units are required.

The object of this invention is accomplished by a method of knitting fabric on a circular knitting machine in which double jersey loops are formed by having the needles arranged in groups of alternate and intervening needles and feeding a ground yarn to alternate groups at each yarn feed. The needles that do not receive a ground yarn at a particular yarn feed move to the next yarn feed while holding any previous yarn fed thereto in the hooks thereof until two ground yarns are received in the hooks thereof and then double loops of two ground yarns are formed at that knitting station.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE PREFERRED EMBODIMENT

Figure 13:
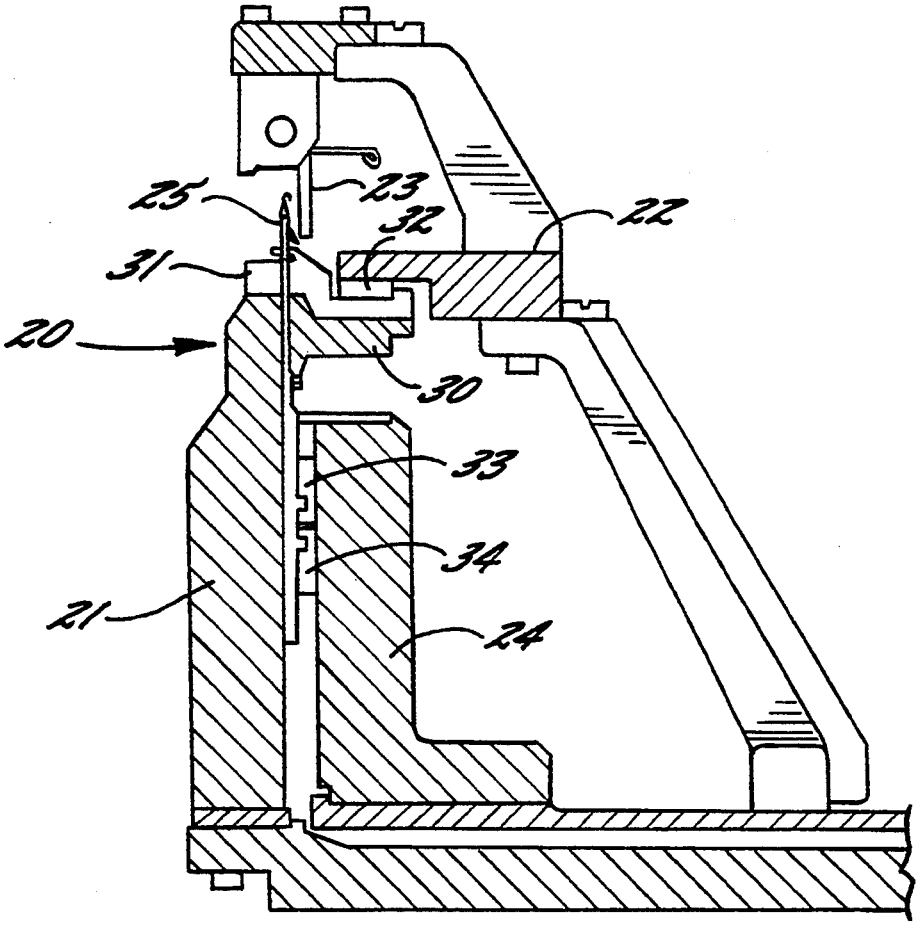
FIG. 13 is a cross sectional view of a knitting machine for forming the knit fabric of the present invention.

Referring now more particularly to the drawings and specifically to FIG. 13, there is illustrated the knitting elements of a circular knitting machine generally indicated at 20. Circular knitting machine 20 is of the single knit type and includes a needle cylinder 21, sinker cap 22, yarn carrier 23 and cam holder 24. The needle cylinder 21 has multiple needle slots extending vertically in the outer periphery thereof. The needle slots have needles 25 and 26 slidably mounted therein. Needles 25 are high butt needles and are mounted in alternate needle slots in cylinder 21, while needles 26 are low butt needles mounted in intervening needle slots in cylinder 21.

A sinker dial 30 is fixed to the top of cylinder 21 for rotation therewith. Sinker dial 30 has multiple radial slots therein and a sinker 31 slidably mounted in each sinker slot. Sinkers 31 have a sinker nose 31*a*, a sinker throat 31*b* and a sinker top 31*c*. Preferably, the difference in height between the top of the sinker nose 31*a* and the sinker top 31*c* is between 1.5 mm and 2.2 mm. A sinker cam 32 is carried by sinker cap 22 for controlling and operating sinkers 31.

Figures 1, 2, 3:
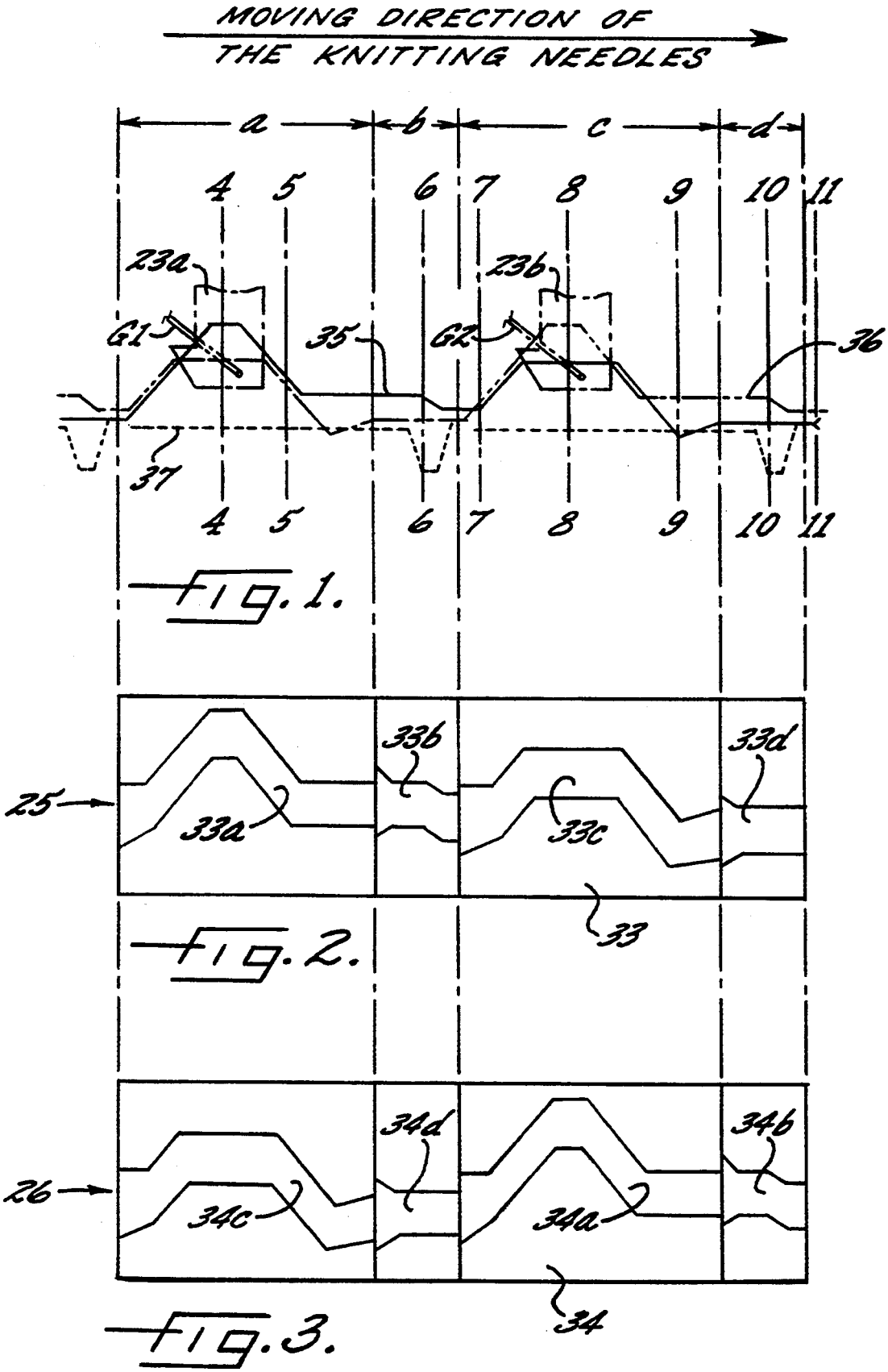
FIG. 1 is a schematic view of the knitting processes of the present invention.
FIG. 2 is a schematic view of the needle selection and operating cam for the high butt knitting needles of the circular knitting machine utilized in the method of the present invention.
FIG. 3 is a schematic view similar to FIG. 2 of the needle selection and operating cam for the low butt needles.

Cam holder 24 mounts a pair of cams 33, 34 for controlling and operating the cylinder needles 25, 26. Preferably, cams 33 and 34 are of the closed type as shown in FIGS. 2 and 3. Cam 33 controls and operates the high butt cylinder needles 25, and cam 34 controls and operates the low butt needles 26.

The needle cams 33 and 34 and sinker cam 32 control the needles 25 and 26 and sinkers 31 in a first process a, a second process b, a third process c and a fourth process d. Cam 33 has the closed cam track thereof divided into cam sections 33*a*, 33*b*, 33*c* and 33*d* corresponding to the first through fourth processes a through d, inclusive. Cam 34 has the closed cam track thereof divided into sections 34*a* through 34*d*, inclusive, corresponding to the third process c, fourth process d, first process a and second process b, respectively. In FIG. 1, the solid line 35 represents the operation or performance line of the high butt cylinder needles 25; the phantom line 36 represents the operation or performance line of the low butt cylinder needles 26; and the dash line 37 represents the operation or performance line of the sinkers 31.

The function or performance of high butt needles 25 is the same in the first and second processes a, b as the function or performance of the low butt needles 26 in the third and fourth processes c, d and the function or performance of the low butt needles 26 in the first and second processes a, b is the same as the function or performance of the high butt needles 25 in the third and fourth processes c, d.

In the first process a, a yarn carrier 23*a* feeds a first ground yarn $G_1$ to the cylinder needles 25, 26. A yarn carrier 23*b* feeds a second ground yarn $G_2$ to the needles 25, 26 in the third process c.

Figure 4:
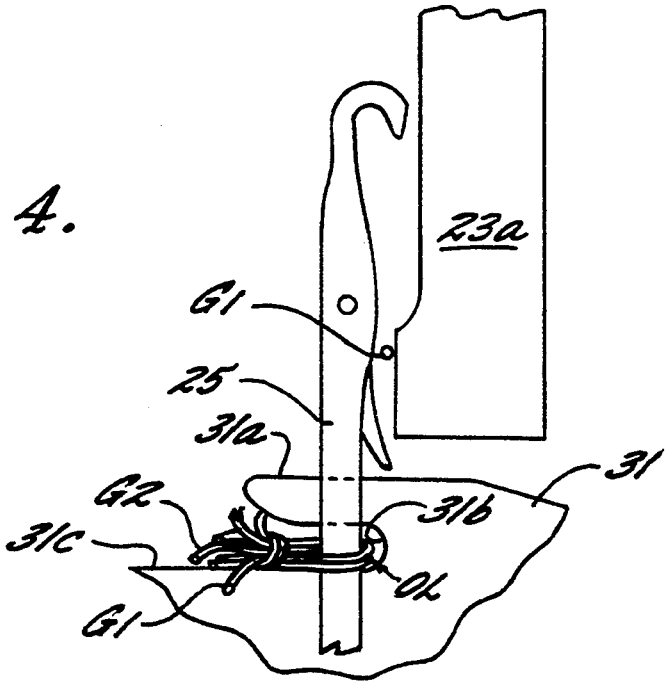
FIG. 4 is a fragmentary enlarged sectional view taken substantially along line 4—4 in FIG. 1.
Figure 5:
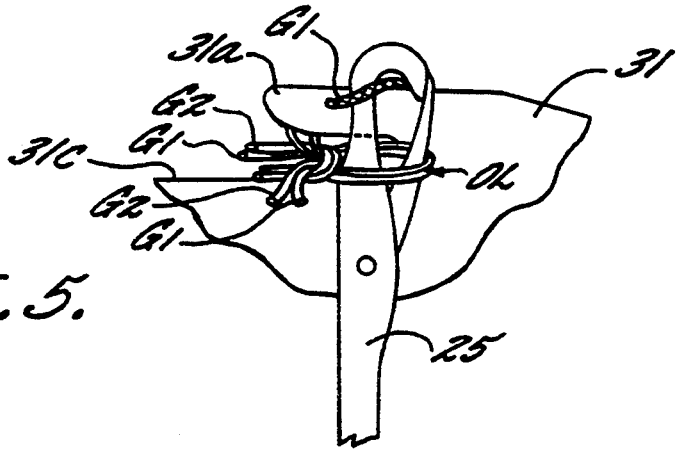
FIG. 5 is a fragmentary sectional view similar to FIG. 4 taken substantially along line 5—5 in FIG. 1.

In the first process a, cam section 33*a* of cam 33 raises the high butt needles 25 to the knitting level (FIGS. 1 and 4) and the old double yarn loops OL clear the latches of the needles 25. At the same time, yarn carrier 23*a* feeds ground yarn $G_1$ to the high butt needles 25. As the needles 25 descend to a first welt position (FIG. 5), the old loops OL close the latches of the needles 25 thereby capturing the ground yarn $G_1$ in the hooks thereof and catching the ground yarn $G_1$ on the nose 31*a* of the sinker 31.

Figure 6:
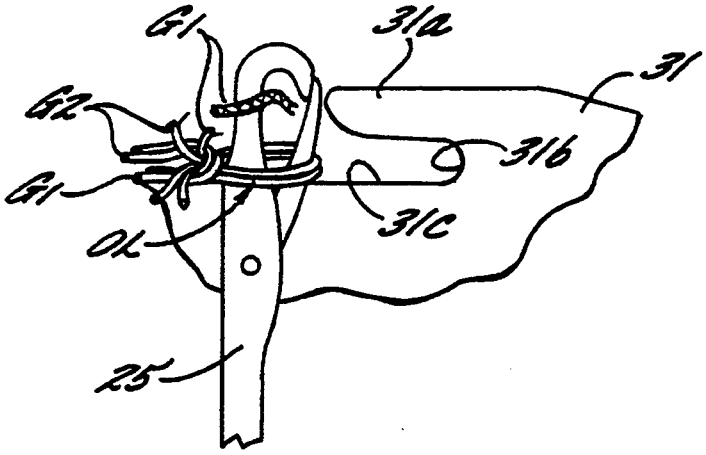
FIG. 6 is a sectional view similar to FIGS. 4 and 5 taken substantially along line 6—6 in FIG. 1.
Figure 7:
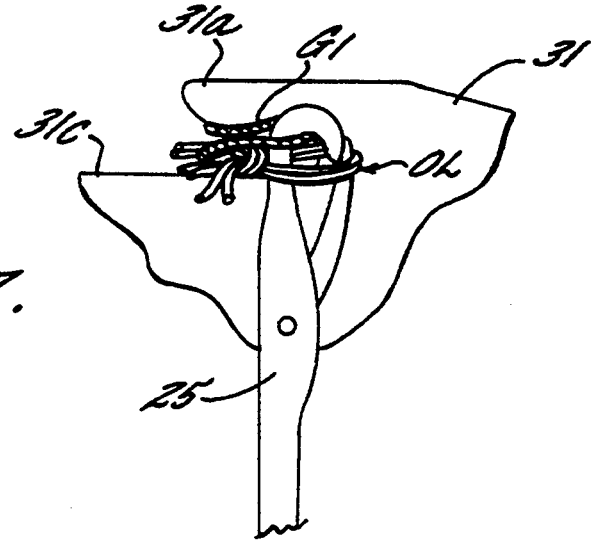
FIG. 7 is a sectional view similar to FIGS. 4 through 6 taken substantially along line 7—7 in FIG. 1.

In the second process h, the sinkers 31. withdraw to the outside and the ground yarn $G_1$ drops off the nose 31*a* of the sinker 31 (FIG. 6). The cylinder needles 25 are then lowered by cam section 33*b* of cam 33 to a second welt position in which the hooks thereof are at the level of the sinker throat 31*b* and the sinkers 31 are advanced so that the old loops OL and the ground yarn $G_1$ are received in the sinker throat 31*b* (FIG. 7).

Figure 8:
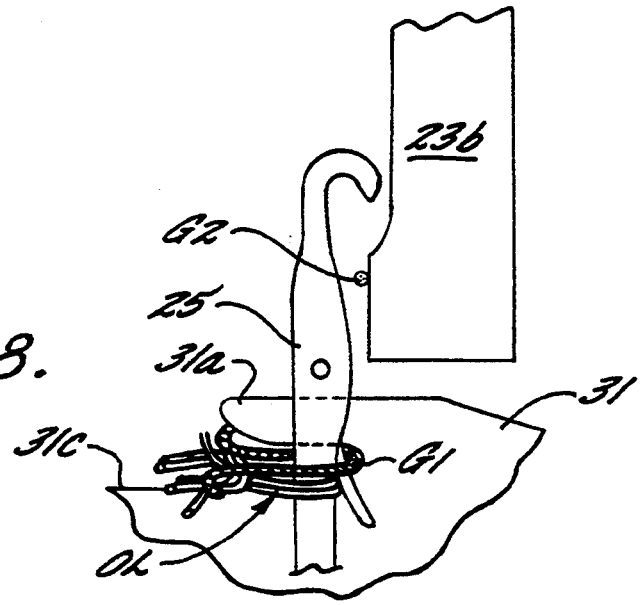
FIG. 8 is a sectional view similar to FIGS. 4 through 7 taken substantially along line 8—8 in FIG. 1.
Figure 9:
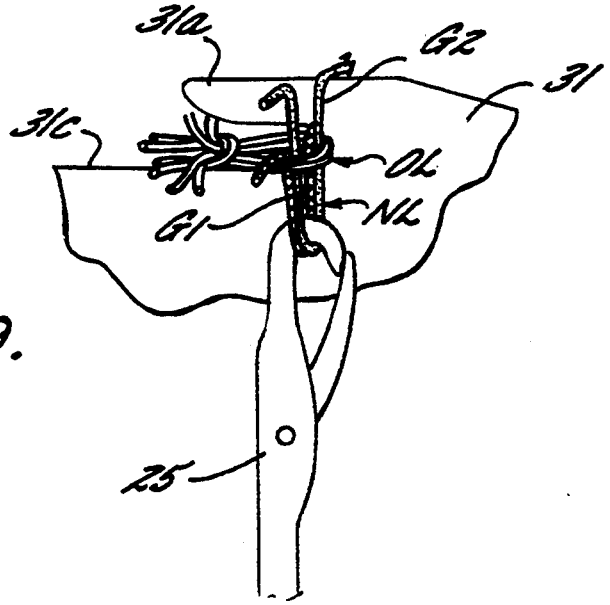
FIG. 9 is a sectional view similar to FIGS. 4 through 8 taken substantially along line 9—9 in FIG. 1.

Cam section 33*c* raises the cylinder needles 25 in the third process c to the tucking level (FIG. 8) in which the old loops OL are held on the shanks of the needles 25 by the sinkers 31 and the ground yarn $G_1$ is held on the needles 25 above the latches thereof. Yarn carrier 23*b* feeds second ground yarn $G_2$ to the needles 25.

Needles 25 are then lowered to the third welt position while catching the second ground yarn $G_2$ in the hooks thereof. The old loops OL close the latches of the needles 25 and a new double yarn loop NL is formed of both of the first and second ground yarns $G_1$ and $G_2$ with the first ground yarn $G_1$ riding over the sinker top 31*c* and the second ground yarn $G_2$ riding over the sinker nose 31*a*.

Figure 10:
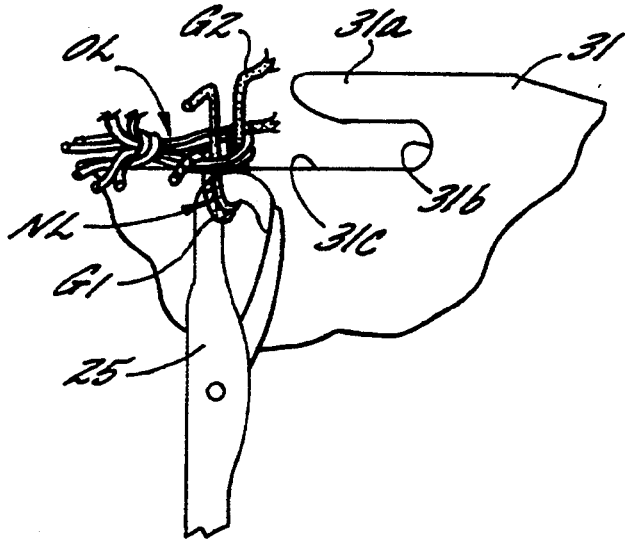
FIG. 10 is a sectional view similar to FIGS. 4 through 9 taken substantially along line 10—10 in FIG. 1.
Figure 11:
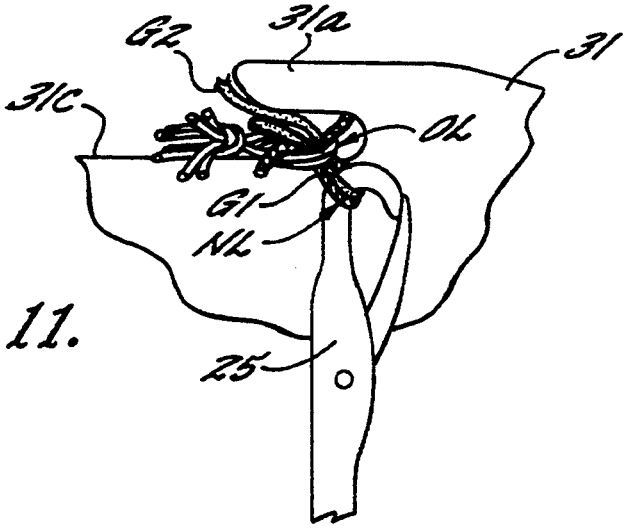
FIG. 11 is a sectional view similar to FIGS. 4 through 10 taken substantially along line 11—11 in FIG. 1.

Once the needles 25 have drawn the new loops NL, the sinkers 31 withdraw outside and the second ground yarn $G_2$ drops off of the sinker noses 31*a* (FIG. 10). Then, the sinkers 31 advance and the old loop OL and the ground yarns $G_1$ and $G_2$ are received and held in the sinker throat 31*b* as the needles 25 move on to the first process a again.

The intervening cylinder needles 26 are controlled and operated by cam 34 in the same manner as cam 33 operates needles 25 except that cam 34 raises needles 26 to the knitting level in the third process and to the tucking level in the first process. Accordingly, the description of the operation or performance of cylinder needles 26 will not be described further, but reference is made to the description of needles 25 herein.

Figure 12:
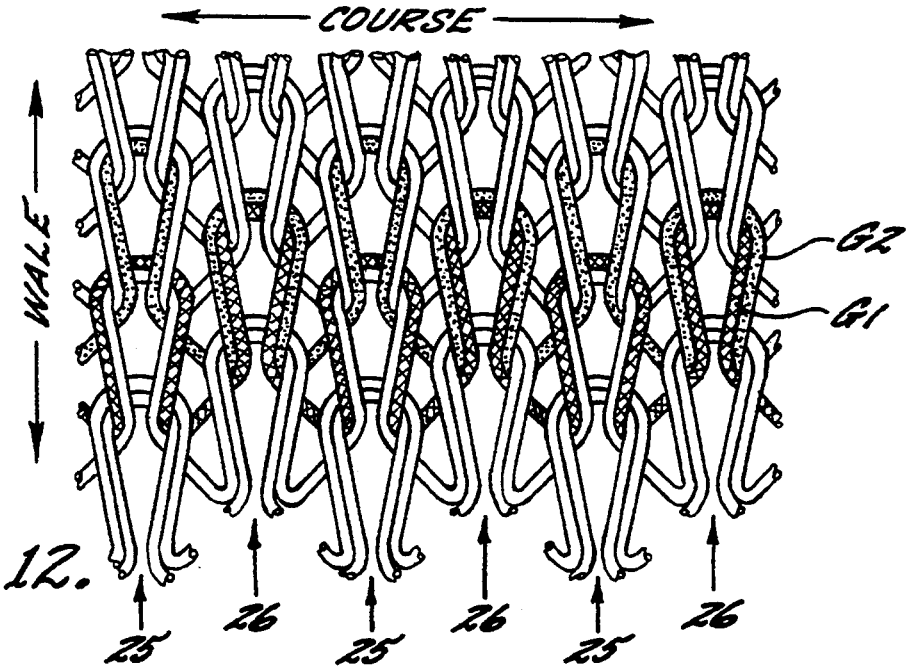
FIG. 12 is a fragmentary schematic view of a fabric knit in accordance with the method of the present invention.

The resulting fabric is shown in FIG. 12 and includes a plurality of alternate needle wales 25 and intervening needle wales 26 formed of stitch loops formed of ground yarns $G_1$ and $G_2$ as described above. The stitch loops in needle wales 26 are offset by one-half course from the stitch loops in needle wales 25. The ground yarn $G_1$ is knit in the stitch loops of all of the needle wales 25 and 26 in a course while a particular ground yarn $G_2$ is knit in the stitch loops of only the needle wales 26 while the ground yarn $G_2$ from the next adjacent course is knit into the stitch loops of the needle wales 25. This fabric structure provides increased elasticity, particularly in the wale direction, without distortion in the stitch loops or between stitch loops. Further, the fabric has a soft hand and greatly improved drapeability.

In the drawings and specifications, there has been set forth a preferred embodiment of the invention, and although specific terms are employed, they are used in a generic and descriptive sense only and not for purposes of limitation.

That which is claimed is:

1. A method of knitting single knit fabric having elasticity, soft hand and drapeability on a circular knitting machine having two types of cylinder latch needles having hooks, shanks and butts, and being arranged alternately on a cylinder of the circular knitting machine, sinkers having a throat, a nose, and a top arranged in a sinker dial, and at least two yarn carriers for feeding two yarns to the needles, the method comprising controlling the cylinder needles in a first process in which alternate needles are raised to a knitting level and intervening needles are raised to a tucking level and in which an old loop is held in the sinker throat of the sinkers and clears the latch of the needle raised to the knitting level and a ground yarn previously fed to the intervening needles remains above the latch in the hook area when those needles are raised to the tucking level and an old loop which has previously cleared the latch is held by the sinker throat on the shank of the intervening needle, feeding a first ground yarn to the alternate and intervening needles, the first ground yarn joining the previously fed ground yarn in the hook of the intervening needle while the first ground yarn is held in the hook of the alternate needle, lowering the alternate needles to a high welt level such that the first ground yarn is drawn over the sinker nose but the old loop remains in the hook of the needles as the alternate needles are moved to a second process while lowering the intervening needles to a low welt level so as to draw the first ground yarn over the sinker nose and the previously fed ground yarn over the sinker top and to knock over the old loop from the intervening needles to form a new loop of two ground yarns as the needles are moved to a second process, controlling the alternate and intervening needles and the sinkers in the second process by holding the alternate and intervening needles in their respective welt levels while withdrawing the sinkers so that the first ground yarn slips off the sinker nose and onto the sinker top and then advancing the sinkers to capture the old loop and the first ground yarn in the sinker throat with respect to the alternate needles and to capture the old loop and the new loop with respect to the intervening needles, moving the needles and sinkers to a third process and controlling the needles and sinkers in the third process to raise the intervening needles to the knitting position while maintaining the sinkers in the advanced position so that the new loop formed in the first process is now an old loop and clears the latch on the intervening needle and to raise the alternate needles to the tucking level so that the first ground yarn remains above the latch of the alternate needle, feeding a second ground yarn to the alternate and intervening needles;

lowering the alternate and intervening needles to the low and high welt levels in the same manner as the intervening and alternate needles were lowered in the first process, moving the needles and sinkers to a fourth process in which the alternate and intervening needles and the sinkers are controlled in the same manner as the intervening and alternate needles and the sinkers were controlled in the second process, and repeating the above steps continuously.

2. The method according to claim 1 further comprising controlling and operating the alternate and intervening needles with cams having closed tracks therein.

3. The method according to claim 1 further comprising drawing the stitch loops over the top of the sinker nose and the sinker top of the sinkers having a difference in height of between 1.5 mm and 2.2 mm.

4. A method of knitting single knit fabric having elasticity, soft hand and drapeability on a circular knitting machine having two types of needles arranged alternately on a cylinder, sinkers arranged in a sinker dial, and at least two yarn carriers for feeding two yarns to the needles, the method comprising continuously controlling and operating the needles, sinkers and yarn carriers through first through fourth processes by raising alternate needles to a knitting level and raising intervening needles to a tucking level in the first process, holding a previously cleared old loop on each needle on a shank of the needle by the sinkers and holding a previously fed yarn in hooks of intervening needles, holding a ground yarn to both alternate and intervening needles, lowering the alternate needles to a high welt level so that the old loop, remains on the alternate needle without being knocked over while lowering the intervening needles to a low welt level so that the old loop is knocked over and a new loop of the previously fed yarn and the first ground yarn is formed, and raising intervening needles to the knitting level and raising alternate needles to the tucking level in the third process, feeding a second ground yarn to both alternate and intervening needles, and lowering the intervening needles to the high welt level and lowering the alternate needles to the low welt level to form a new loop of the first and second ground yarns.

* * * * *